US006208227B1

(12) United States Patent
Remillard et al.

(10) Patent No.: US 6,208,227 B1
(45) Date of Patent: Mar. 27, 2001

(54) ELECTROMAGNETIC RESONATOR

(75) Inventors: Stephen K. Remillard, Arlington Heights; Donald E. Richied, Maple Park; Edward A. Freeman, Arlington Heights; Nikolay Ortenberg, Wilmette; Peter Winandy, Elgin; James D. Hodge, Lincolnwood, all of IL (US)

(73) Assignee: Illinois Superconductor Corporation, Mt. Prospect, IL (US)

( * ) Notice: Subject to any disclaimer, the term of this patent is extended or adjusted under 35 U.S.C. 154(b) by 0 days.

(21) Appl. No.: 09/008,740

(22) Filed: Jan. 19, 1998

(51) Int. Cl.[7] ..... H01P 7/00

(52) U.S. Cl. ..... 333/219; 333/99 S; 505/210; 505/700; 505/866

(58) Field of Search ..... 333/995, 219, 333/219.1; 505/700, 701, 866, 210

(56) References Cited

U.S. PATENT DOCUMENTS

| | | | | |
|---|---|---|---|---|
| 4,667,172 | | 5/1987 | Longshore et al. | 333/134 |
| 4,996,188 | * | 2/1991 | Kommrusch | 505/210 |
| 5,008,640 | * | 4/1991 | Accatino et al. | 333/219.1 |
| 5,097,238 | * | 3/1992 | Sato et al. | 333/219.1 |
| 5,136,270 | * | 8/1992 | Hatanaka et al. | 333/219.1 |
| 5,221,913 | * | 6/1993 | Ishizaki et al. | 333/219.1 |
| 5,233,319 | * | 8/1993 | Mizan et al. | 333/219.1 |
| 5,340,797 | | 8/1994 | Hodge et al. | 505/4.7 |
| 5,347,246 | * | 9/1994 | Bellows et al. | 333/219.1 |
| 5,629,266 | * | 5/1997 | Lithgow et al. | 333/995 X |

FOREIGN PATENT DOCUMENTS

| | | | | |
|---|---|---|---|---|
| 410614 | * | 1/1991 | (EP) | 333/995 |
| WO 97/18599 | | 5/1997 | (WO) . | |
| WO 97/45890 | | 12/1997 | (WO) . | |

OTHER PUBLICATIONS

Hamersky, J; "Contribution of Surface Adsorbed Water to the Loss Factor of Polycrystalline $Al_2O_3$"; *INTERCERAM*; No. 2; 1977; pp 119,120,131.*

Lancaster M.T. et al; "Superconduction Micowave Resonators"; *IEE Proceedings–H*; vol. 139, No. 2; Apr. 1992; pp 149–156.*

"High Temperature Superconductor Element for a Fault Current Limiter," U.S. Ser.l No. 08/490,943, filed Jun. 15, 1995, 20 pages, Figs. 1–14.

Delayen et al., "rf properties of an oxide–supercondcutor half–wave resonant line," *Appl. Phys. Lett.*, vol. 52(11), Mar. 14, 1988, pp. 930–932.

Radcliffe et al., "Mult–mode microwave measurements on a coaxial cavity with high–temperature superconductor centre conductor," *Supercond. Sci. Technol.*, vol. 3, 1990, pp. 151–154.

Remillard et al., "Generation of Intermodulation Products by Granular $Yba_2Cu_3O_{7-x}$ Thick Films," Proceedings of the SPIE Conference on High–Temperature Microwave Superconductors and Applications, vol. 2559, Jul. 9–14, 1995, pp. 1–15.

(List continued on next page.)

*Primary Examiner*—Benny Lee
(74) *Attorney, Agent, or Firm*—Marshall, O'Toole, Gerstein, Murray & Borun

(57) ABSTRACT

An electromagnetic resonator has a resonant element made of a high-temperature superconducting material such as $YBa_2Cu_3O_{7-x}$. The resonant element has a substrate coated with a thermally conductive layer such as silver, over which the high-temperature superconductor material is placed. The thermally conductive layer distributes heat along the length of the resonant element to minimize the effects of localized heating at, for instance, the center of the resonator. The resonant element is held to a housing by a mounting mechanism including a post made of polycrystalline alumina. The polycrystalline alumina transfers heat away from the center of the resonant element and may be used to suppress spurious response due to second harmonic resonance.

5 Claims, 8 Drawing Sheets

OTHER PUBLICATIONS

Smith et al., "Frequency Dependence of Surface Resistance of Bulk High Temperature Superconductor," *Electronic Letters*, vol. 26(18), Aug. 30, 1990, pp. 1486–1487.

International Search Report, International Applcation No. PCT/US99/01068, International Filing Date Jan. 19, 1999.

Japanese Patent Abstract, Publication No. 07221502, Publication Date Aug. 18, 1995, Title: "Band–Pass Filter and Branching Device Comprising Dual Mode Dielectric Resonator."

* cited by examiner

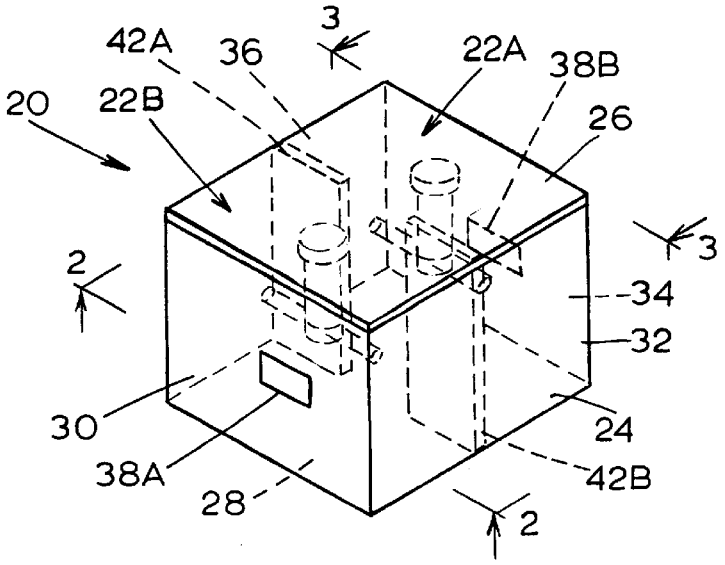
FIG. 1
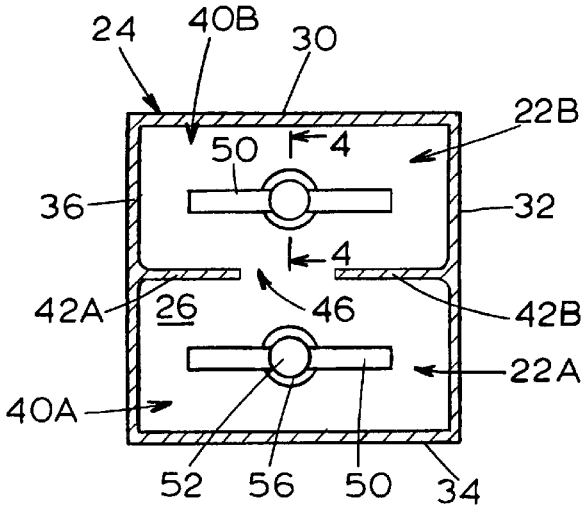
FIG. 2
FIG. 3
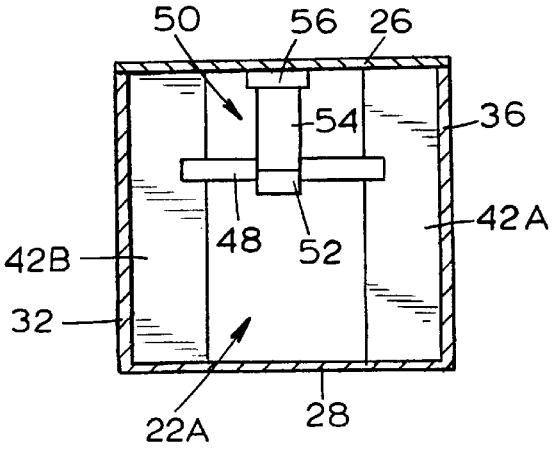

FIG. 4
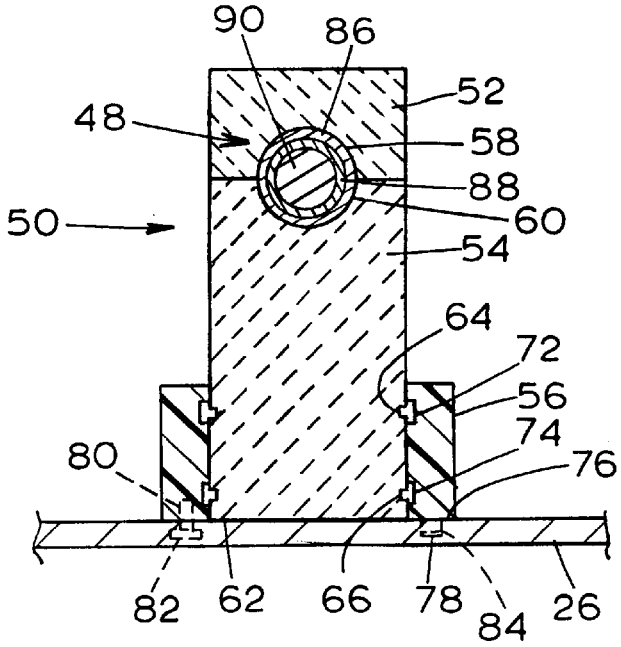
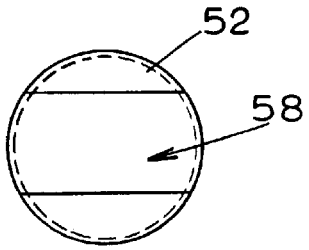
FIG. 5
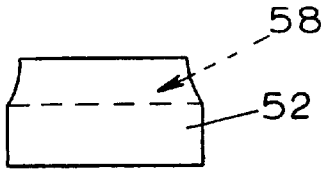
FIG. 6
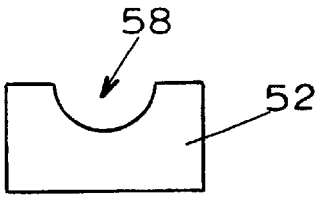
FIG. 7

FIG. 11
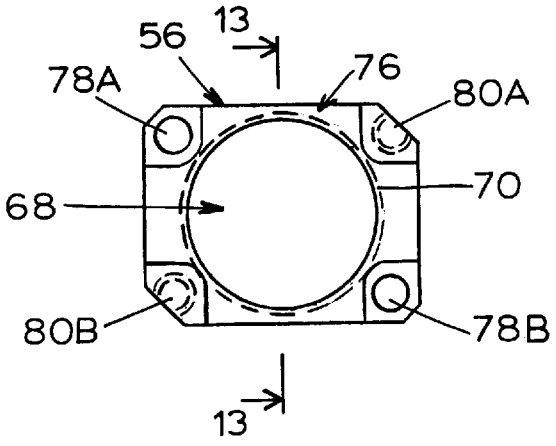
FIG. 12
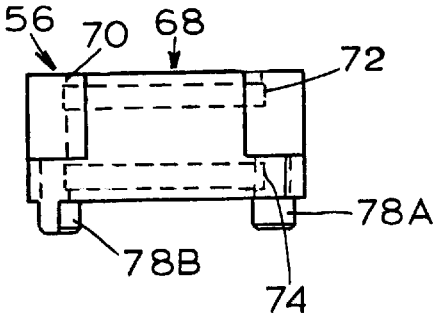
FIG. 13
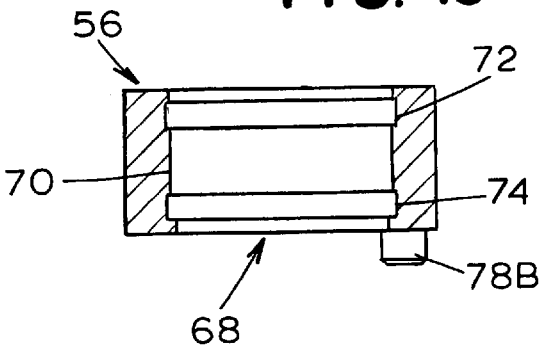
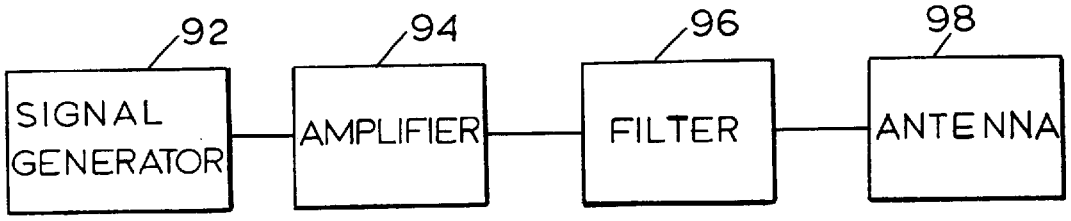
FIG. 14

ELECTROMAGNETIC RESONATOR

FIELD OF THE INVENTION

The present invention relates generally to electromagnetic resonators, and more particularly to structures for distributing and dissipating heat generated in those resonators.

BACKGROUND OF THE INVENTION

Electromagnetic resonators are often used in filters in order to pass or reject certain signal frequencies. To optimize filter performance, the resonators should have a minimum of signal loss in the passed frequency range. Such losses in resonators can occur in a variety of modes, but all manifest themselves through the generation of heat caused by resistance to current flowing on the surfaces of conductive elements in the resonator. For that reason, conductors in resonators are usually chosen for their low-surface resistance. However, even with low-surface resistance metals, such as copper or silver, significant heating and signal losses may occur. The heating can further increase the surface resistance of the metal, thereby adding to signal loss.

In order to minimize losses in resonators, superconducting materials have been used. For instance, if a cavity resonator is used, the walls of the cavity or a resonant element located inside the cavity may be made from or coated with a superconducting material. While superconductors have a significantly lower surface resistance than ordinary conductors, a relatively small amount of heat will still be generated in a superconducting resonator. Dissipation of that heat may not be a significant problem if the power of the filtered signal is relatively low. Thus, when a superconducting resonator is used, for instance, as a component in systems receiving low-power radio frequency signals, heat build-up in the superconductor may not have significant adverse effects. However, if the superconducting resonator is used, for instance, as a component in a high-power signal transmission system, heat build-up in the superconducting material can result in serious performance degradation.

As heat builds up in a superconducting material, the temperature of that material may rise above its critical temperature. Once a superconductor rises above its critical temperature, it loses its superconducting properties, thereby increasing the surface resistance drastically, and further generating heat until the component completely fails. This phenomenon is known as thermal runaway. Therefore, removing heat from a resonator handling relatively high power signals, particularly when superconducting materials are used, may be required for effective resonator performance. Moreover, removal of heat must be accomplished without significantly increasing the overall loss of the resonator.

SUMMARY OF THE INVENTION

In accordance with one aspect of the present invention, an electromagnetic resonator includes a housing having walls and a resonant element. The resonant element is made of a layer of high-temperature superconducting material and a layer of thermally conductive material having a thermal conductivity above about 22.5 W/m·K at 77K. The resonant element is attached to the housing and spaced from the walls and experiences a momentary peak magnetic field above about 160 A/m without experiencing thermal runaway.

The resonant element may include a metallic substrate coated with a layer of thermally conductive material. The thermally conductive material may be silver, and the high-temperature superconducting material may be $YBa_2Cu_3O_{7-x}$. The housing defines a cavity, and the resonant element may be located in the cavity, which may be filled with a thermally conductive gas.

The thermally conductive layer preferably has a thermal conductivity above about 100 W/m·K and more preferably above about 200 W/m·K at 77K. The resonator preferably does not exhibit thermal runaway at a momentary peak magnetic field strength of above about 270 A/m.

In accordance with another aspect of the present invention, a signal transmission system includes a signal-generating device emitting a signal having a power and an electromagnetic resonator for receiving a signal where the resonator includes a resonant element having a surface coated with a high-temperature superconducting material. A layer of thermally conductive material adjacent the high-temperature superconducting material disperses heat along the thermally conductive layer. The thermally conductive material has a thermal conductivity of above about 22.5 W/m·K at 77K and the power of the signal results in a peak magnetic field on the resonant element of above about 160 A/m.

In accordance with another aspect of the present invention, a signal transmission system includes a signal-generating device and an amplifier for increasing the power of a signal from the signal-generating device. The system includes a filter coupled to the amplifier and having a resonator with a layer of high-temperature superconducting material and a layer of thermally conductive material adjacent the high-temperature superconducting material. The system also includes a signal transmitter. The amplified signal has a power above about 5 watts and the thermally conductive material has a thermal conductivity above about 160 W/m·K at 77K.

The filter may have at least two resonators. Each resonator has a mounting mechanism and each mounting mechanism has a volume. At least one resonator mounting mechanism may have a volume different than the volume of at least one other resonator mounting mechanism.

In accordance with yet another aspect of the present invention, a resonator includes a housing having at least one wall defining a cavity and a resonant element located in the cavity. A mounting mechanism attaches the resonant element to the housing wall and is made of a dielectric material having a thermal conductivity above about 1 W/m·K at 77K.

The mounting mechanism may be made of polycrystalline alumina and is preferably 99.8% pure polycrystalline alumina. The mounting mechanism may include a post made of polycrystalline alumina, an epoxy and a polymer base, where the post and base are epoxied together. The post may be in contact with the wall, and the base attaches the stand to the wall.

In accordance with still another embodiment of the present invention, a resonator mounting mechanism for attaching a resonant element to a wall of a resonator cavity includes a post made of a thermally conductive dielectric material having a first end adapted to receive the resonant element and a second end having a flat-bottom surface. The mounting mechanism also includes a base connected to the post near the bottom surface of the post. The base holds the post to the cavity wall with the bottom surface of the post in contact with the wall to transmit heat from the resonant element, through the post, to the cavity wall.

In accordance with another embodiment of the present invention, an electromagnetic filter includes a first resonator having a first wall, a first resonant element, and a first mounting mechanism attaching the first resonant element to the first wall. The filter also includes a second resonator having a second resonant element, a second wall, and a second mounting mechanism attaching the second resonator to the second wall. The first mounting mechanism has a first volume and the second mounting mechanism has a second volume, and the first volume is different than the second volume.

Each resonator has a second harmonic mode, and the second harmonic mode has a location of its electric field maximum. Each mounting mechanism may be located adjacent the second harmonic mode electric field maximum. The first mounting mechanism and the second mounting mechanism may be made of a material having a dielectric constant above about three and more preferably above about nine.

In accordance with still another aspect of the present invention, an electromagnetic resonator includes a housing having at least one wall defining a cavity, a resonant element located in the cavity, and a mounting mechanism attaching that resonant element to the housing wall. The mounting mechanism is comprised of a dielectric material having a dielectric constant above about nine.

The electromagnetic resonator claimed and disclosed can be better understood by one skilled in the art from the following detailed description in conjunction with the accompanying drawings.

BRIEF DESCRIPTION OF THE DRAWINGS

FIG. 1 is a perspective view of a filter including resonators of the present invention;

FIG. 2 is a cross-sectional view taken along the line 2—2 of FIG. 1;

FIG. 3 is a cross-sectional view taken along the line 3—3 of FIG. 1;

FIG. 4 is a cross-sectional view through the resonant element and stand of the resonator of FIG. 2 along the line 4—4;

FIG. 5 is a top plan view of the cap of the resonator mounting mechanism shown in FIG. 3;

FIG. 6 is a side elevational view of the cap of FIG. 5;

FIG. 7 is an end elevational view of the cap of FIG. 5;

FIG. 11 is a bottom plan view of the base of the resonator mounting mechanism shown in FIG. 3;

FIG. 12 is a side elevational view of the base of FIG. 11;

FIG. 13 is a cross sectional view of the base taken along the line 13—13 of FIG. 11;

FIG. 14 is a block diagram of a system utilizing a filter having a resonator of the present invention;

DETAILED DESCRIPTION OF THE PREFERRED EMBODIMENT

Figure 8:
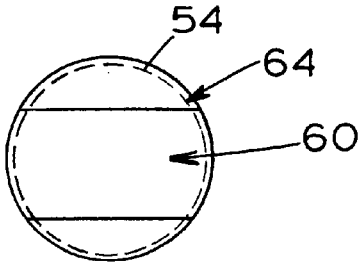
FIG. 8 is a top plan view of the post of the resonator mounting mechanism shown in FIG. 3.

Referring initially to FIG. 1, a filter indicated generally at 20 has resonators indicated generally at 22A and 22B. Although many of the numbered elements are shown in more than one Figure, each is described herein primarily in connection with the Figure that best shows the particular element. On The filter 20 includes a housing base 24 and a cover 26, which may be made of any metal such as copper, silver or aluminum, and attached together with bolts (not depicted.) The housing base 24 has a lower wall 28 and side walls 30, 32, 34, and 36. Coupling mechanisms 38A and 38B extend through walls 30 and 34, respectively. The coupling mechanisms 38A and 38B are for coupling signals to and from the filter 20. The coupling mechanisms 38A and 38B may be of a variety of constructions, including a probe (not depicted) extending into the filter, or maybe a coupling loop of the type disclosed in U.S. patent application Ser. No. 08/558,009, now U.S. Pat. No. 5,731,269, the disclosure of which is incorporated herein by reference.

As best seen in FIG. 2, each resonator 22A and 22B includes a cavity 40A and 40B, respectively, each of which are defined by the housing base 24, cover 26, and partition walls 42A and 42B. The partition walls 42A and 42B do not completely close the cavities 22A and 22B from each other, but instead define a gap 46, which allows signals to be coupled between the resonators 22A and 22B. The size and shape of the gap 46 may be adjusted as is known to those skilled in the art to adjust the electromagnetic coupling between the resonators 22A and 22B. In addition, coupling screws (not depicted) may be inserted or withdrawn from the gap 46 to adjust the coupling.

Although only two resonators, 22A and 22B, are shown in the filter 20, the present invention can be used with filters having any number of resonators. Such resonators could be placed in separate housings or in one housing with multiple cavities such as is shown in Assignee's co-pending U.S. patent application Ser. No. 08/556,371, now U.S. Pat. No. 5,843,871, the disclosure of which is incorporated herein by reference. Although the configuration of the filter 20 is most suitable for a bandpass filter, a transmission line connected to individual coupling loops in each cavity may be used with the present invention as shown in now U.S. Pat. No. 5,843,871 in order to provide a bandstop filter.

As best seen in FIG. 3, each resonator 22A and 22B (not shown herein) includes a resonant element 48, which is held to the cover 26 by a mounting mechanism indicated generally at 50. The mounting mechanism consists of a cap 52, a post 54, and a base 56.

Figure 9:
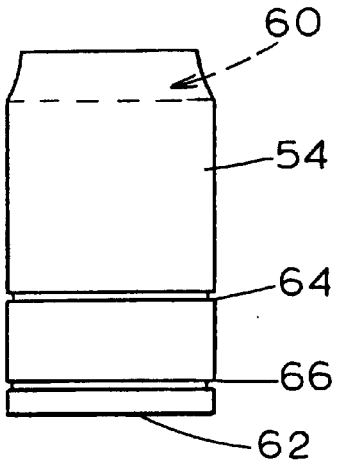
FIG. 9 is a side elevational view of the post of FIG. 8.
Figure 10:
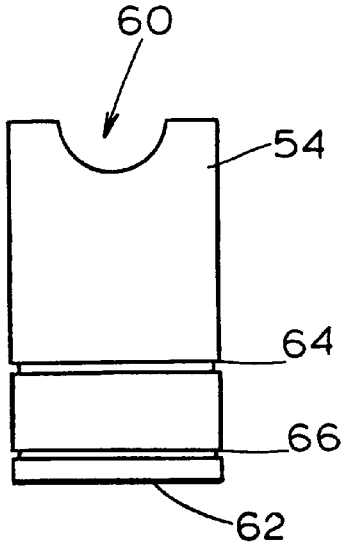
FIG. 10 is a side elevational view of the post of FIG. 8 perpendicular to the view of FIG. 9.

As seen in FIGS. 5–7, the cap 52 includes a groove 58. The groove 58 should have a cross section which matches the cross section of the resonant element 48 (FIG. 3). As seen in FIGS. 8–10, the post 54 has a similar groove 60. The cross section of the groove 60 should also closely match the cross section of the resonant element 48. Two notches 64 and 66 may be placed towards the bottom 62 of the post 54, as shown in FIGS. 9 and 10.

As seen in FIGS. 11–13, the base 56 has a central opening 68 which matches the outer surface of the post 54 (FIGS. 8–10). The central opening 68 is defined by a curved interior wall 70. As best seen in FIGS. 12 and 13, the interior wall 70 may have notches 72 and 74 which define a slightly expanded circumference over that of the interior wall 70. Located on the bottom 76 (FIG. 11) of the base 56 are pegs 78A (FIGS. 11 and 12) and 78B. Also on the bottom 76 of the base 56 are threaded openings 80A and 80B.

As shown in FIG. 4, the cap 52 contacts the post 54 to hold the resonant element 48 in place. The cap 52 may be epoxied to the post 54, with an epoxy such as alumina impregnated CTD CryoBond™ 621. Epoxy may also be used to attach the base 56 to the post 54, and in particular the epoxy should occupy the spaces where the notches 64 meet the notches 72, and where the notches 66 meet the notches 74. When the epoxy hardens, it forms a washer-type structure in the notches 64, 66, 72 and 74 to firmly secure the base 56 to the post 54. The base 56 is in turn held to the cover 26 by one or more screws 82 inserted into the threaded openings 80. Each peg 78 on the base 56 engages a recess 84 on the cover 26 in order to assure proper alignment of the resonator mounting mechanism 50.

The use of the base 56 to attach the resonator mounting mechanism 50 to the cover 26 allows maximum contact between the flat bottom 62 of the post 54 and the cover 26 without the need of any intervening epoxy between the post 54 and the cover 26. Such contact allows heat to be efficiently transferred from the post 54 to the cover 26. If the post 54, in turn, is selected from a material having a relatively high thermal conductivity, heat generated in the resonant element 48 is transferred through the post 54 to the cover 26 and dissipated by the cover 26 or other parts of the filter housing. Matching the cross-section of the groove 58 in the cap 52 and the groove 60 in the post 54 to the cross-section of the resonant element 48 aids in the transfer of heat away from the resonant element 48. In order to maximize heat transfer from the post 54 to the cover 26, the post 54 should protrude slightly from bottom of the base 56 to ensure that the post 54 is pressed tightly against the cover 26.

The post 54 and cap 52 are preferably made of a polycrystalline alumina such as a 99.8% pure polycrystalline alumina rod as made by Coors Ceramics. Polycrystalline alumina of other purity levels or made by other manufacturers such as LucALox™ made by General Electric can also be used. Polycrystalline alumina has a relatively high thermal conductivity (800 W/m·K) while having a relatively low dielectric loss tangent at 77K. Other suitable materials with a high thermal conductivity include beryllia, magnesia, other ceramics, or single crystal ceramics such as sapphire. When made from polycrystalline alumina, the post 54 and the cap 52 will conduct heat away from the resonant element 50 while adding a minimal amount of loss to the resonator. Such heat conduction is particularly important for high-power applications of the resonators. The post 54 and cap 52 preferably have a thermal conductivity of about one W/m·K, more preferably above about 100 W/m·K, and most preferably above about 500 W/m·K at 77K.

The use of polycrystalline alumina, which has a moderate dielectric constant, as the resonator mounting mechanism also may facilitate suppression of spurious filter response generated by higher order modes. Half-wave resonators of the type disclosed herein generally use the fundamental mode of resonance when employed in filters. The resonators, however, also have a second mode of resonance at approximately twice the frequency of the fundamental mode. The fundamental mode has an electric field minimum at the middle of the resonant element, while the second harmonic has an electric field maximum in the middle of the resonant element. By placing the polycrystalline alumina post with its dielectric constant of approximately 9.8 at the middle of the resonant element, the frequency of the second harmonic is loaded downward with minimal change to the fundamental mode. If posts of dissimilar volumes, i.e. diameters, are used in neighboring resonators, the second harmonic resonance will be different in each of those neighboring resonators. Since the second harmonic will be at a different frequency in those neighboring resonators with dissimilar posts, coupling of those second harmonic frequencies is suppressed. For instance, in a filter designed to have a fundamental center frequency at 1.9 GHz, a resonator with a three-eighths inch diameter polycrystalline alumina post will have a second harmonic resonance at 2.7 GHz. A resonator with a half-inch diameter polycrystalline alumina post will, however, have a 2.45 GHz. second harmonic resonance. Coupling between the 2.7 GHz frequency resonance and the 2.45 GHz frequency resonance is minimal, thus suppressing transmission of the second harmonic resonance. In a filter with multiple resonators, it may be desirable to have posts of one diameter for the input and output resonators, and a second diameter for all of the other, intermediate resonators in order to suppress spurious signals generated from higher modes. It may also be desirable to have posts of different diameters in every resonator.

The high dielectric constant of the mounting mechanism may also confine the electric field of the second harmonic largely to the interior of the post. This effect may also severely weaken the coupling of the second harmonic between neighboring resonators, even when the posts are of the same size. This benefit is not seen in posts made of Ultem® with a low dielectric constant (approximately 3.0) compared to that for polycrystalline alumina with a high dielectric constant.

The base 56 may be made from a polymer such as Ultem®, manufactured by General Electric, which has a relatively low dielectric loss, is easily machined into complex shapes, and is strong enough to hold the remainder of the resonator mounting mechanism and resonant element securing to the cover 26. Other materials include nylon, Rexolyte®, or other molded plastics or resins.

As seen in FIG. 4, the resonant element consists of an outer superconductive layer 86, a thermally conductive layer 88, and a substrate 90. The superconductive layer is preferably $YBa_2Cu_3O_{7-x}$ made in accordance with the teachings of U.S. Pat. No. 5,340,797, the disclosure of which is incorporated herein by reference. The thermally conductive layer is preferably silver with a thickness of approximately 0.003 inches. The core 90 is preferably made of 316 or 304 stainless steel.

Placing the thermally conductive layer in the resonant element 48 is advantageous because heating in the resonant element is not uniform. In general, heating at a point in the resonant element will be proportional to the strength of the magnetic field at that point. For rod-type resonators which have a length which is equal to approximately half the wavelength of the center frequency of the resonator, the highest magnetic field region is in the middle of the resonant element 48 where it is attached to the mounting mechanism 58 (FIG. 3.) Therefore, heat buildup is a particular concern in the center of the resonant element 48. High-temperature superconducting materials are ceramics and are usually poor thermal conductors. The substrates on which superconductor is often placed, such as stainless steel, zirconia, etc. also exhibit poor thermal conductivity, particularly in temperature ranges below the critical temperature (90K) for $YBa_2Cu_3O_{7-x}$. The thermal conductivity at 77K for 304 or 316 stainless steel is 7 W/m·K, for zirconia 22.5 W/m·K, and for $YBa_2Cu_3O_{7-x}$ is 6 W/m·K. Silver has a thermal conductivity of 400 W/m·K at 77K. The use of thermally conductive layer 88 such as silver distributes the heat along the length of the resonant element 48 to minimize heat build-up at the center. The thermal conductivity of the layer should be above that for YBCO (22.5 W/m·K) and preferably above about 100 W/m·K, more preferably above about 200 W/m·K, and most preferably about 400 W/m·K.

The cavities 40 may be filled with a heat-conducting gas such as helium to remove the heat from the resonant element 48. The ends of the resonant element 48 may be uncoated with superconductor because low surface resistance material is not needed at the ends where the magnetic fields, and thus, current flow on the surface is low.

The use of a polycrystalline alumina to remove heat from the resonant element and the use of a conductive layer such as silver to distribute heat along the length of the resonant element are particularly useful in high-power applications (above about 1 watt and generally above about 5 watts) such as is shown in FIG. 14. A high-power system may include a signal generator 92, such as a cellular telephone base station. The signal generator 92 is connected to an amplifier 94 which increases the power of the signals from the signal generator. The high-power signals from the amplifier are then sent to a filter 96 utilizing a resonator of the present invention. The filter signal then passes to an antenna 98. Amplification of signals may be necessary to broadcast over a large area or to broadcast to relatively poor receivers such as handheld cellular telephones.

EXAMPLE 1

A resonant element (sample 21710) was made in accordance with the present invention by placing a layer of $YBa_2Cu_3O_{7-x}$ over a substrate consisting of stainless steel coated with 0.003 inches of silver. The $YBa_2Cu_3O_{7-x}$ was "reactively textured" in accordance with the teachings of U.S. Pat. No. 5,340,797. The resonant element was placed into a resonator cavity pressurized with helium at 77K. A signal was coupled to the resonator and the peak magnetic field (Hrf) on the resonant element was calculated. The surface resistance of the resonant element was also calculated. Peak magnetic field strength and surface resistance were calculated in accordance with the formulae set forth in Remillard, S. K. et al., "Generation of Intermodulation Products by Granular $YBa_2Cu_3O_{7-x}$ Thick Films," *Proceedings of SPIE Conference on High-Temperature Microwave Superconductors and Applications*, Vol. 2559, Jul. 4, 1995. The power to the resonant element was increased in increments, while calculating the peak Hrf and surface resistance. No thermal runaway was exhibited, even at a peak magnetic field of approximately 270 amps/meter (A/m).

A second resonant element (sample 22049) was prepared in accordance with a method previously used for low power applications, by placing a layer of $YBa_2Cu_3O_{7-x}$ on a yttria-stabilized zirconia substrate without a thermally conductive layer. The $YBa_2Cu_3O_{7-x}$ was made by a recrystallization process in which the material is slowly cooled through its pertectic temperature. Sample 22049 was placed in the resonator cavity used with sample 21710 and surface resistance and peak magnetic field were calculated. The power to the resonator was incrementally increased until thermal runaway was observed at approximately 165 A/m.

Figure 15:
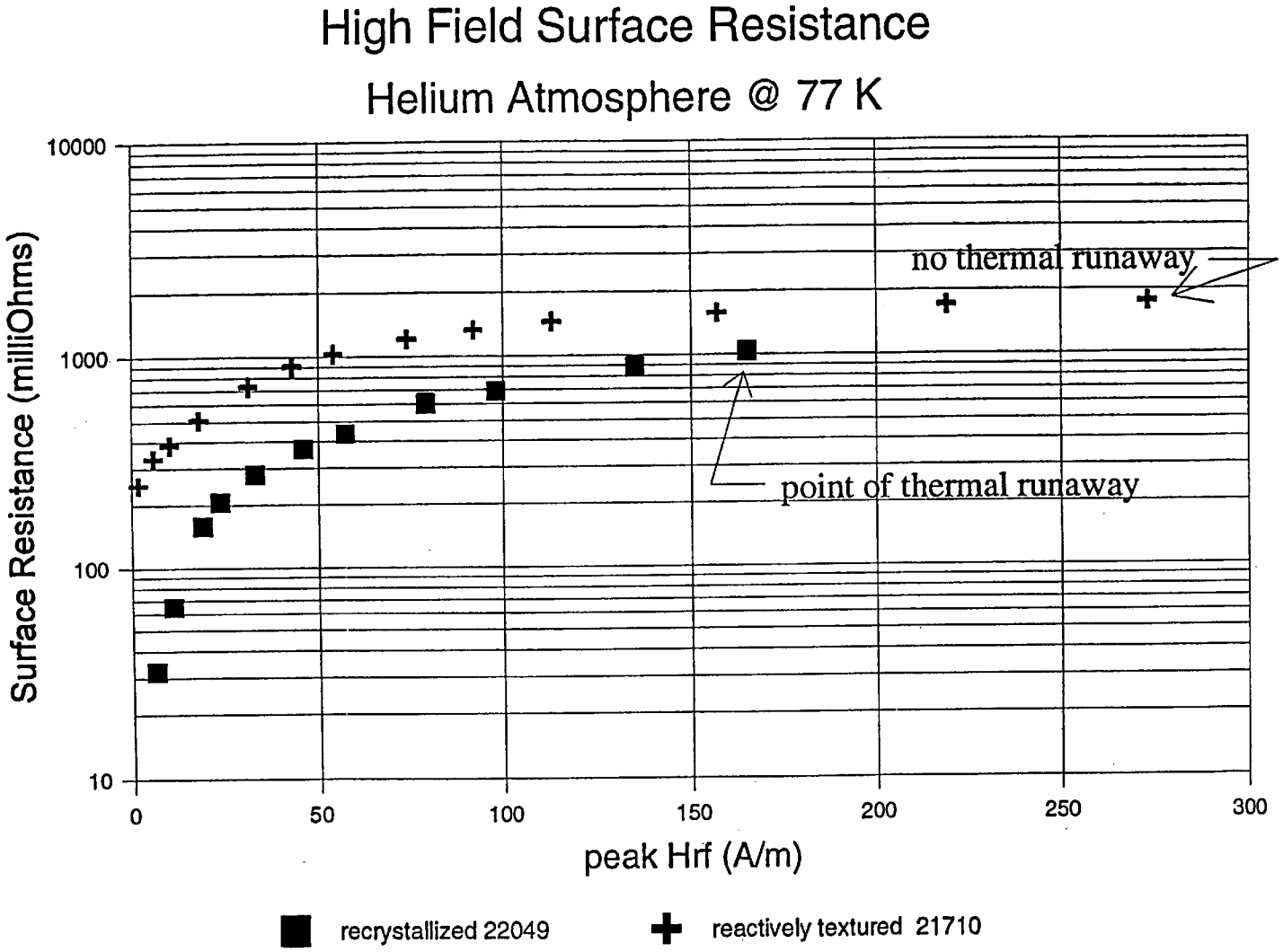
FIG. 15 is a graph of peak magnetic field strength versus surface resistance comparing a resonator made in accordance with the present invention and another.

As is shown in FIG. 15, the sample with the conductive layer was able to accept higher power signals without thermal runaway, even though the reactively textured $YBa_2Cu_3O_{7-x}$, used with the conductive layer, has a higher surface resistance than recrystallized $YBa_2Cu_3O_{7-x}$, without the conductive layer. (For every peak Hrf below thermal runaway, the recrystallized material has a lower surface resistance than the reactively textured material.) Given the higher surface resistance exhibited, one would expect a lower thermal runaway power for the reactively textured sample, because heat generated generally increases with surface resistance. However, the use of the thermally conductive layer, in this case silver, is believed to disperse the heat along the length of the resonator, away from the peak magnetic field at the center of the resonator, thus postponing thermal runaway.

EXAMPLE 2

Figure 16:
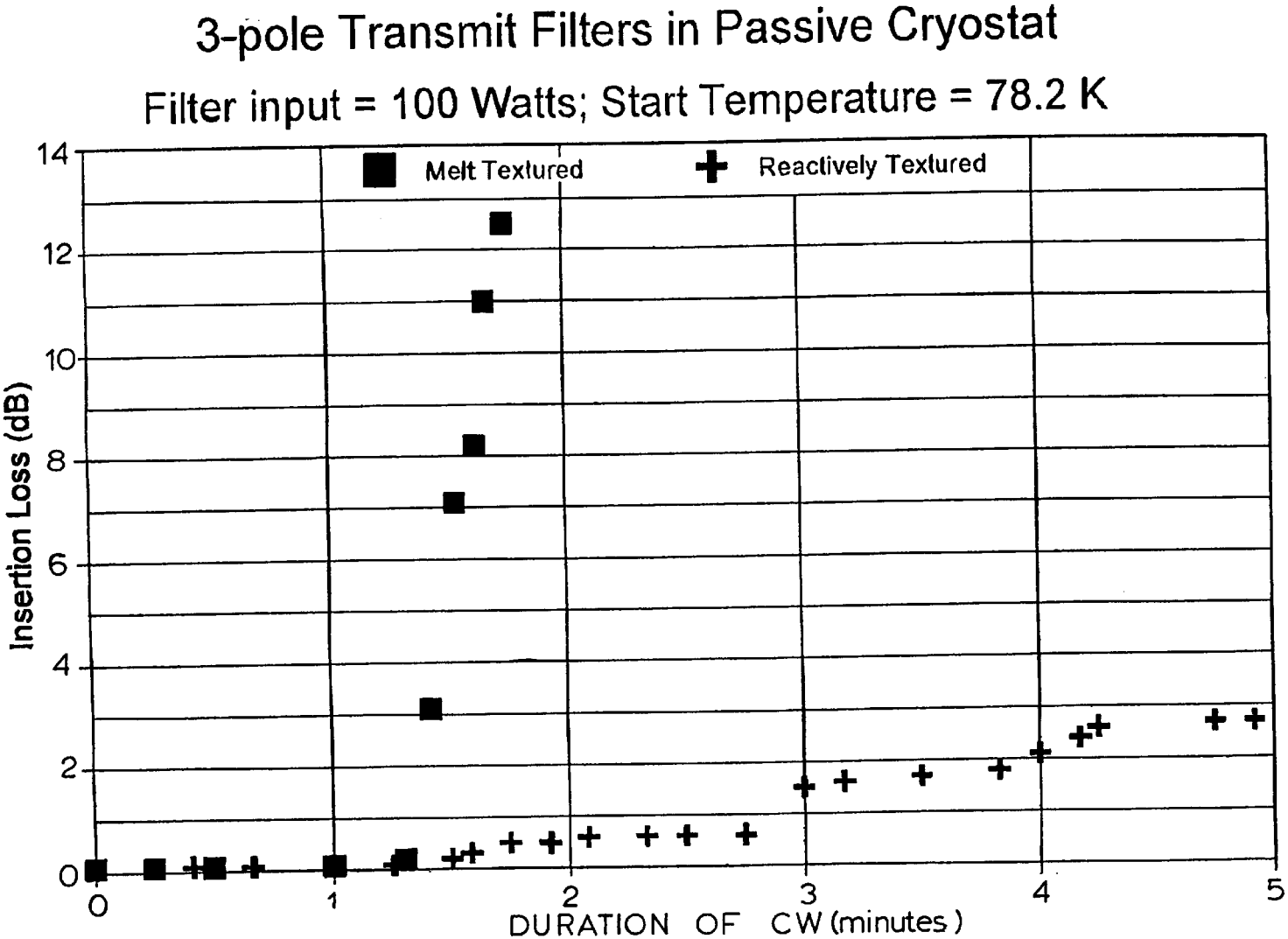
FIG. 16 is a graph of insertion loss versus time for filters receiving 100 watt signals, comparing resonators made in accordance with the present invention and other resonators.

Two three-pole filters were constructed. The first filter utilized reactively textured $YBa_2Cu_3O_{7-x}$ resonant elements coated over a substrate of stainless steel with a 0.003 inches layer of silver, of the type set forth in Example 1. The second filter utilized resonant elements having a melt-textured layer of $YBa_2Cu_3O_{7-x}$ on a zirconia substrate of the type set forth in Example 1. Each filter received a continuous 100 watt signal. For this example, the resonant cavities were filled with helium gas to aid in heat dissipation. The filter without the thermally conductive substrate reached thermal runaway after approximately one minute and twenty seconds. The filter with the reactively textured material over the silver-coated substrate experiences slow degradation, but does not reach thermal runaway even after five minutes. A graph of insertion loss versus time for the two filters is set forth in FIG. 16.

EXAMPLE 3

Figure 17:
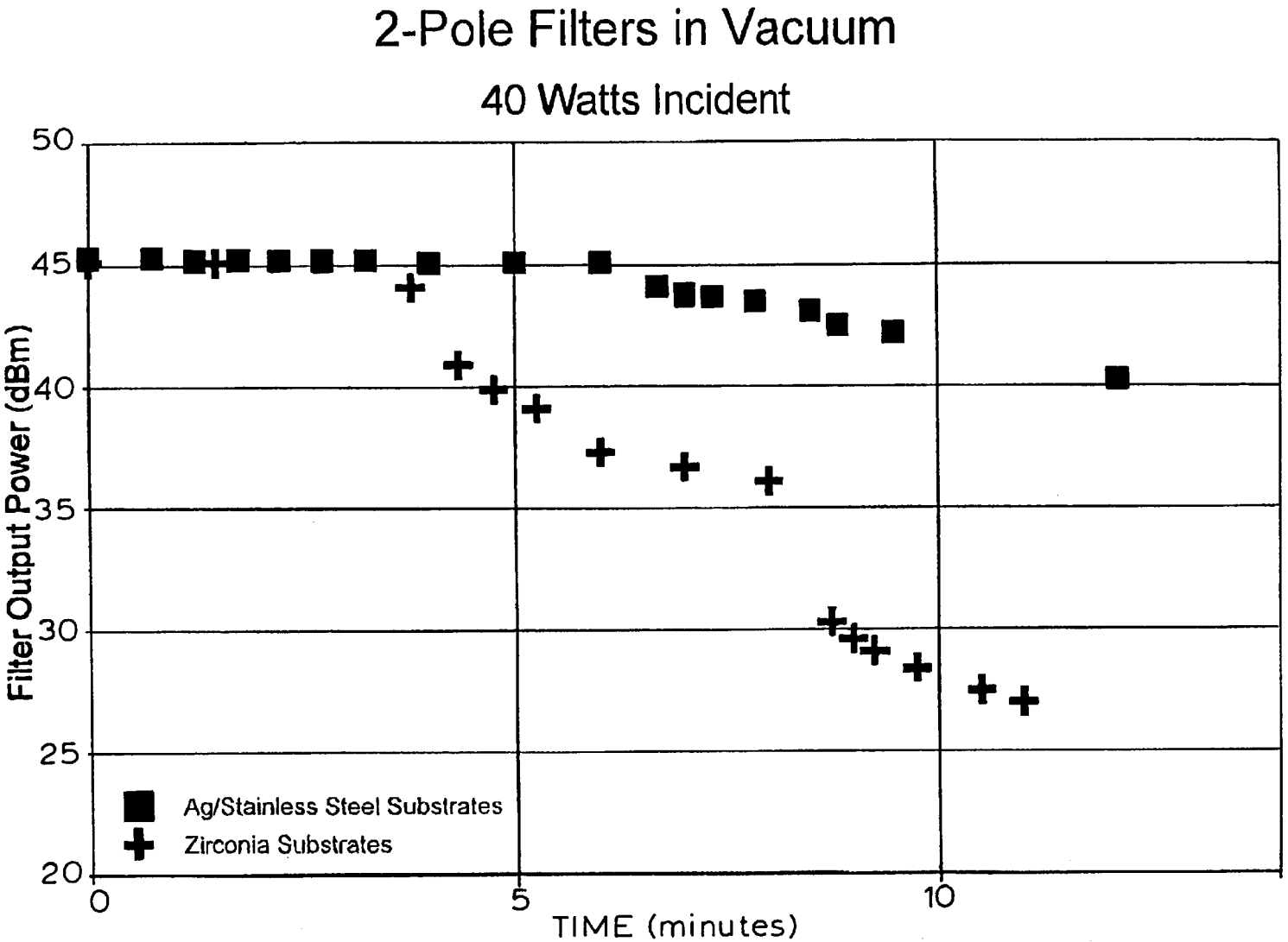
FIG. 17 is a graph of filter output power versus time for filters receiving 40 watt signals, comparing resonators made in accordance with the present invention with other resonators.

Two two-pole filters were constructed: one with the silver/stainless steel substrates of Examples 1 and 2; and one with zirconia substrates of the type in Examples 1 and 2. A continuous power of 40 Watts was supplied to each of the filters after each filter had been evacuated. As seen in FIG. 17, the filter with zirconia substrates began to experience thermal runaway at approximately 3½ minutes. After approximately 6½ minutes, the silver-coated substrates began to slowly degrade.

EXAMPLE 4

A ten-resonator filter with $YBa_2Cu_3O_{7-x}$ resonant elements was prepared using polycrystalline alumina mounting mechanisms, as previously described, to hold the resonant elements to the walls of the filter cavities. The cavities were evacuated and the filter was placed in a cryostat to maintain it at 72K. A 10.8 W input signal was supplied to the filter, and the output power was measured.

A second ten-resonator filter was prepared identically to the one described in the preceding paragraph, except that the mounting mechanisms were made entirely from Ultem® polymer.

Figure 18:
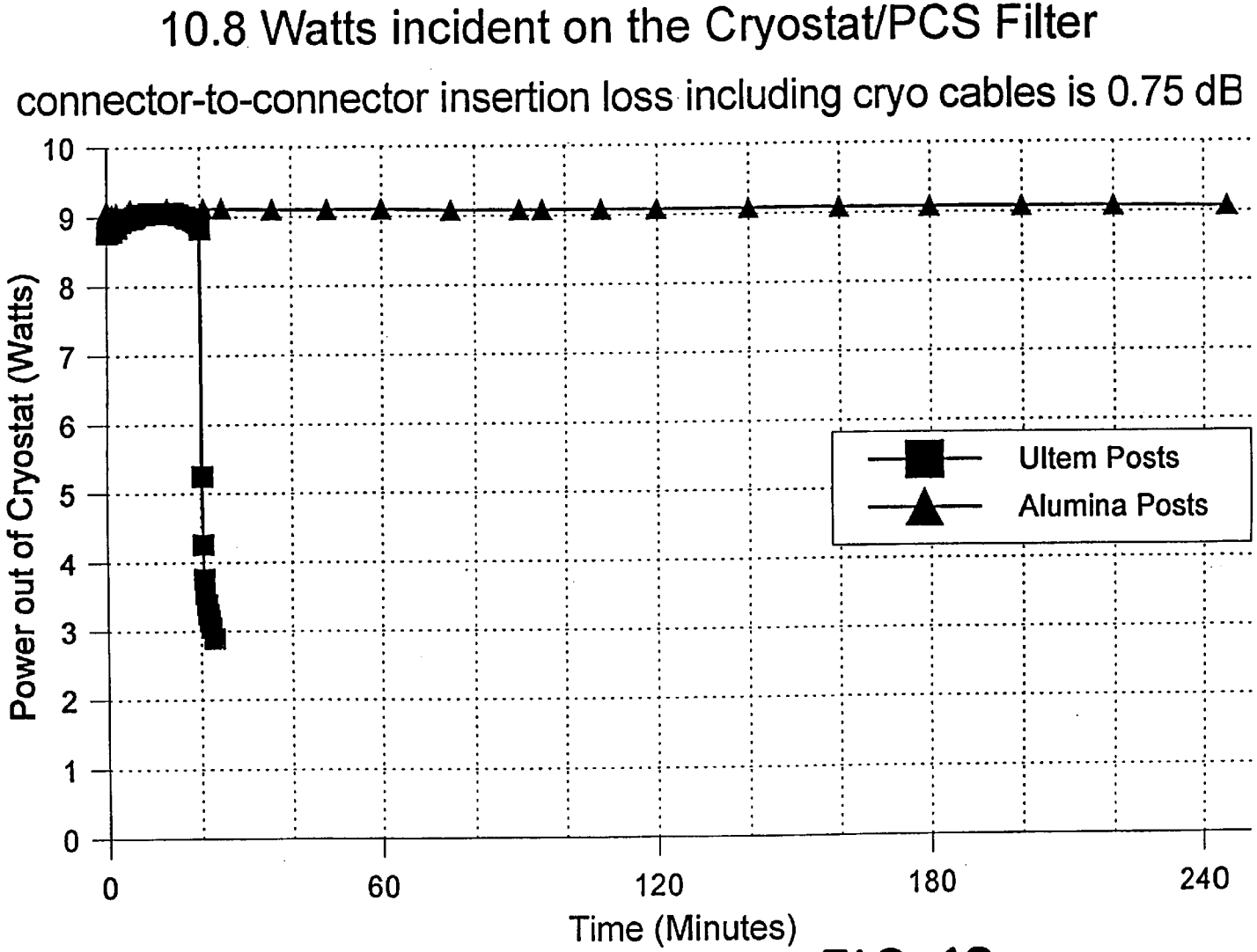
FIG. 18 is a graph of signal power versus time for an electromagnetic filter, comparing resonators utilizing a resonator mounting mechanism of the present invention and resonators utilizing other mounting mechanisms.

As shown on the graph of FIG. 18, the device utilizing polycrystalline alumina mounting mechanisms transmitted approximately nine watts, substantially continuously over time. The device utilizing Ultem® mounting mechanisms also initially transmitted approximately nine watts. After approximately fifteen minutes, the filter began to fail and almost immediately fell to an output of less than three watts. It is believed that heat generated in the resonator over time cannot be adequately dissipated with the Ultem® mounting mechanism, which has a thermal conductivity of about 0.2 W/m·K at 77K. Heat build-up occurs, increasing the surface resistance in the resonant element, leading to thermal runaway and failure. When polycrystalline alumina, with a cryogenic thermal conductivity of about 800 W/m·K, is used to mount the resonant elements, a substantial heat pathway is formed to reduce heat build-up.

EXAMPLE 5

Two resonators were prepared, one utilizing the polycrystalline alumina mounting mechanisms as discussed in Example 4, and one using the polymer mounting mechanisms as also discussed in Example 4. A 40 milliwatt signal was applied to each of the resonators, where the resonators were undercoupled so that little or no output signal was coupled from the resonators. In an undercoupled resonator, the surface fields are generally two orders of magnitude more intense than inside a filter with properly coupled resonators. In each of the resonators, a 43 A/m surface magnetic field was calculated. The quality factor, Q, of each resonator was measured using a vector network analyzer. After 12 minutes, the Q of the resonators, having polymer mounting mechanisms began to drop due to thermal runaway. The resonator with the polycrystalline alumina maintained a constant Q for one hour. The incident power was then raised on the resonator with the polycrystalline alumina post to 250 milliwatts resulting in a peak magnetic field of about 110 A/m. The Q was observed for one half hour with no change. The incident power was then raised to one watt, inducing an approximate peak magnetic field of about 215 A/m. The Q began to drop at a rate of approximately 0.1% per minute. When the incident power was raised to two watts, resulting in a field of 300 A/m, thermal runaway occurred immediately.

The foregoing detailed description has been given for clearness of understanding only, and no unnecessary limitations should be understood therefore, as modifications would be obvious to those skilled in the art.

What is claimed is:

1. A resonator mounting mechanism for attaching a resonant element to a wall in a resonator cavity, the mounting mechanism comprising:

a post comprised of a low dielectric loss thermally conductive material having a first end adapted to receive the resonant element and a second end having a flat bottom surface; and a base comprised of a material different than the post connected to the post near the bottom surface of the post;

wherein the base holds the post to the cavity wall with the bottom surface of the post in contact with the wall to transmit heat from the first end of the post to the second end of the post and through the post to the cavity wall.

2. The resonator of claim 1 wherein the post has a thermal conductivity of above about 100 W/m·K.

3. The resonator of claim 1 wherein the post has a thermal conductivity of above about 500 W/m·K.

4. The resonator of claim 1, wherein the post is comprised of polycrystalline alumina.

5. The resonator of claim 1 wherein the post has a thermal conductivity of above about 100 W/m·K.

* * * * *